US005720547A

United States Patent [19]

Baird

[11] Patent Number: 5,720,547

[45] Date of Patent: Feb. 24, 1998

[54] MODULAR STORAGE BINS

[76] Inventor: Merrill F. Baird, P.O. Box 323, Rowlett, Tex. 75030-0323

[21] Appl. No.: 500,686

[22] Filed: Jul. 11, 1995

[51] Int. Cl.[6] ..... A47B 77/00

[52] U.S. Cl. ..... 312/107; 312/117; 312/332.1; 220/552; 220/662

[58] Field of Search ..... 312/107, 108, 312/117, 222, 230.1, 332.1; 206/769, 771; 220/552, 602, 662, 665; 211/74

[56] References Cited

U.S. PATENT DOCUMENTS

| | | | |
|---|---|---|---|
| D. 300,887 | 5/1989 | Evans . | |
| D. 347,764 | 6/1994 | Cohen et al. . | |
| 425,824 | 4/1890 | Ohmer | 312/222 |
| 451,599 | 5/1891 | Meigs | 312/107 |
| 1,148,238 | 7/1915 | Kline | 312/107 X |
| 2,128,854 | 8/1938 | Sagendorph, II et al. | 312/107 X |
| 2,316,384 | 4/1943 | Abramson | 220/662 X |
| 2,511,949 | 6/1950 | Simon | 312/107 |
| 3,743,372 | 7/1973 | Ruggenone | 312/108 |
| 4,266,695 | 5/1981 | Rupenoz | 222/185 |
| 4,714,305 | 12/1987 | Service . | |
| 4,928,833 | 5/1990 | Huizenga . | |
| 4,951,826 | 8/1990 | Tompkins . | |
| 4,971,209 | 11/1990 | Todd . | |
| 5,368,203 | 11/1994 | Friedrich et al. . | |
| 5,392,934 | 2/1995 | Fox . | |
| 5,466,058 | 11/1995 | Chan | 312/107 X |

FOREIGN PATENT DOCUMENTS

| | | | |
|---|---|---|---|
| 567011 | 11/1923 | France | 312/107 |
| 748556 | 7/1933 | France . | |
| 958717 | 3/1950 | France . | |
| 1451610 | 9/1966 | France . | |
| 571495 | of 1958 | Italy | 312/107 |
| 2067520 | 7/1981 | United Kingdom | 220/552 |

*Primary Examiner*—Peter M. Cuomo
*Assistant Examiner*—James O. Hansen
*Attorney, Agent, or Firm*—Richard C. Litman

[57] ABSTRACT

Modular storage bins provide for the bulk containment and storage of various commodities and goods, and are particularly useful in the kitchen or pantry for the storage of foods and spices. One or more identically sized open sleeves are installable beneath or alongside an existing cabinet or shelf, or alternatively may be placed atop an existing countertop or shelf. A mounting plate may be provided for additional attachment security for the sleeves, if desired. Each of the sleeves are adapted for the containment of one or more specially configured bins, with the bins being provided in various sizes. The largest bins have dimensions which are integral multiples of the smaller bins, i.e., the largest bins are two and three times the width and height of the intermediate sized and smallest bins. Thus, two half width bins, or a two by two matrix of four intermediate bins, or a three by three matrix of nine of the smallest bins may be installed in any given sleeve. The smallest bins are particularly adapted for use as spice containers, and are completely closed with the exception of a dispenser on one end. The bins and sleeves are preferably formed of a transparent material, thus enabling a user to view the quantity and type of goods contained therein. A latching mechanism may also be installed on at least some of the bins, to preclude inadvertent removal from the sleeve.

12 Claims, 7 Drawing Sheets

MODULAR STORAGE BINS

FIELD OF THE INVENTION

The present invention relates generally to storage containers and the like, and more specifically to various sizes and configurations of storage bins. The different sizes are even multiples of one another, thus allowing an integral number of smaller bins to fit within the same area occupied by a single larger bin.

BACKGROUND OF THE INVENTION

The typical household kitchen includes various cupboards and drawers which serve to collect small quantities of different commodities (spices, etc.), and perhaps other articles as well. Oftentimes, such commodities and articles are placed on a single shelf of a cupboard or cabinet, and it can be difficult to find the specific spice or other article or object amid the congestion.

Various devices have been developed as a response to the above problem, but generally do not provide a totally satisfactory solution. Lazy susan type units, wherein one or more shelves are constructed as a rotary unit, enable persons to access the rear portion of the shelves more easily, but still fail to compartmentalize the materials thereon to enable a person to find the desired substance more easily. Smaller storage drawers and cabinets have also been developed (primarily for hardware), but generally the drawers or bins of such units are all of equal size in a given cabinet, and cannot be exchanged for drawers of different sizes in order to hold larger or smaller objects.

Thus, a need will be seen for modular storage bins, which bins may be provided in sizes equivalent to multiple integers of a smaller base size, in order to allow a whole number of the drawers to fit within a bin sleeve of standardized size. The bin sleeves or holders should be installable in virtually any position, either resting atop another object or secured to the side wall or underside of another object (shelf, cupboard, etc.). Preferably, the bins and sleeves are formed of a clear material, to enable a person to view the contents, and should have securing means to hold the individual bins within the appropriate sleeves, and/or dispensing means for bulk commodities or other material stored therein. Finally, the bins should be adaptable to food storage in the kitchen, pantry, or other suitable area, as well as to storage of other articles (e.g., hardware, fasteners, etc.) in the shop, garage, or other environment.

DESCRIPTION OF THE PRIOR ART

U.S. Pat. No. 4,714,305 issued to Robert S. Service on Dec. 22, 1987 describes a Spice Rack comprising a rack or shelf portion which telescopes vertically from an intermediate portion, which intermediate portion in turn telescopes horizontally from an outer case. No separate enclosed containers for various bulk goods are disclosed, and the complex action required to access the rack portion (extending the intermediate portion from the case and then raising the rack portion from the intermediate portion) is unlike the horizontally sliding or telescoping single action required of the present modular storage bins. Moreover, since all goods contained by the Service rack are in their own containers, Service does not disclose the use of transparent materials.

U.S. Pat. No. 4,928,833 issued to Lee M. Huizenga on May 29, 1990 describes a Storage Organizer System And Means For Installing The Same. The system is based upon one or more horizontal bars secured to a wall; with at least two vertical panels being hung from the bar(s). One or more horizontal shelves are then installed between the vertical panels. No fully enclosed drawers or bins are disclosed, nor are any telescoping or horizontally sliding components disclosed, as provided by the present modular storage bins. Huizenga also does not provide for transparency of any of the panels or components.

U.S. Pat. No. 4,951,826 issued to Rodney R. Tompkins on Aug. 28, 1990 describes a Compact Disc Display And Storage Board comprising a board with a plurality of first fastener components (Velcro-™) secured thereto. The cooperating fastener components are secured to the backs of the compact disc cases, allowing the cases to be removably affixed to the board. No closure means is provided over the board, no different sizes of bins or other units is described, and no transparent materials are disclosed by Tompkins, which features are provided by the present invention.

U.S. Pat. No. 4,971,209 issued to Richard Todd on Nov. 20, 1990 describes a Bottle Storage And Serving Holder, comprising a unitary rack having an upper horizontal shelf with a series of holes therein. The holes are adapted for the support of inverted bottles placed therein. Todd does not disclose the use of transparent materials, as the bottle contents are readily visible in any case. No moving components (sliding drawers, dispensers, etc.) are disclosed by Todd, and the Todd holder is not adaptable for the storage of bulk commodities, as provided by the present modular storage bins.

U.S. Pat. No. 5,368,203 issued to Rainer Friedrich et al. on Nov. 29, 1994 describes a Spice Rack With Magnetically Held Spice Containers. The containers comprise a series of jars or the like, with ferrous metal lids. The lids are held in position by a magnet installed within the rack. The spice jars are suspended from above by their metal lids, and are removed from the rack by pulling downward. No horizontally moving drawers or modular components are disclosed by Friedrich et al., and the only disclosure of transparent materials is in the jars themselves, and not in any component of the rack. The present modular storage bins do not rely upon any substantial metal components, magnetic or otherwise.

U.S. Pat. No. 5,392,934 issued to Larry G. Fox on Feb. 28, 1995 describes an Apparatus And Method For Adjustably Supporting Furnishings On A Wall Surface. The apparatus comprises a horizontal rail secured to a wall, generally on the order of a chair rail or the like. A plurality of clips may be adjustably attached to the back of the article to be suspended from the rail, with the clips hooking to the upper edge of the rail. The present storage bins may be secured to a vertical surface such as a wall, or beneath an overlying shelf or the like, but are not adapted to use the Fox attachment system.

U.S. Pat. No. D-300,887 issued to Paul R. Evans on May 2, 1989 describes a design for a Wall Unit, comprising a plurality of open horizontal shelves apparently of glass or other transparent material. No closure means is indicated for any of the shelves or other area of the Evans unit, and no removable modular bins or drawers are disclosed, as provided by the present invention.

U.S. Pat. No. D-347,764 issued to Milton L. Cohen et al. on Jun. 14, 1994 describes a design for a Condiment Container, comprising a single unit having convex sides and a curvilinear upper portion. One embodiment includes dispensing holes therein. No modular units, transparent construction, closure means, or means of assembling multiple units in a unitary array, are disclosed by Cohen et al., which features are provided by the present modular storage bins.

French Patent Publication No. 748,556 to Jmpexal E. G. and published on Jul. 6, 1933 describes a pantry cabinet or the like, comprising a plurality of shelves accessible by means of hinged doors. A plurality of differently sized drawers is also indicated, but there is no disclosure of any modular construction, whereby plural smaller drawers may be installed in the same space as a single larger drawer, as may be done with the present invention. Moreover, at least some of the smaller drawers of the present invention are completely closed with the exception of a dispensing opening, and may be formed of transparent material so the contents may be viewed, which features are not disclosed by the French patent publication.

French Patent Publication No. 958,717 to Reinhard E. Seifert and published on Mar. 15, 1950 describes a medicine cabinet or the like, having a plurality of apparently adjustable open shelves therein. Only two closed drawers are apparently disclosed, with no modular interchangeability of differently sized components, no transparent construction, and no components adapted as sealed dispensing units, being disclosed by Seifert.

Finally, French Patent Publication No. 1,451,610 to Jean P. Zaiger and published on Sep. 2, 1966 describes a cigarette lighter holder or the like, apparently comprising a generally rectangular and unitary structure formed of a transparent sheet material. Two apparently magnetic strips of material are located on one side of the device, apparently for securing the device to a metal surface. No modular construction of multiple bins is disclosed, nor is any means of closing the device, as provided by the present invention.

None of the above noted patents, taken either singly or in combination, are seen to disclose the specific arrangement of concepts disclosed by the present invention.

SUMMARY OF THE INVENTION

By the present invention, improved modular storage bins are disclosed.

Accordingly, one of the objects of the present invention is to provide improved modular storage bins which may be provided in different sizes, with larger sizes being substantially integral multiples of the smaller sizes, whereby a plurality of smaller sized bins may be used in place of a single larger sized bin, in a standard sleeve unit.

Another of the objects of the present invention is to provide improved modular storage bins which are adapted for the storage of bulk commodities or other materials or articles therein.

Yet another of the objects of the present invention is to provide improved modular storage bins in which at least some bins are completely closed, with the exception of dispensing means at one end thereof.

Still another of the objects of the present invention is to provide improved modular storage bins which are preferably formed of transparent sheet material, such as acrylic or other plastic.

A further object of the present invention is to provide improved modular storage bins which are installable beneath an overlying surface or to the side of a vertical surface, and which may include a mounting plate for more secure attachment.

An additional object of the present invention is to provide improved modular storage bins at least some of which bins include latching means engaging the bin sleeve or enclosure, and precluding inadvertent removal of the bins from the sleeve.

A final object of the present invention is to provide improved storage bins for the purposes described which are inexpensive, dependable and fully effective in accomplishing their intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
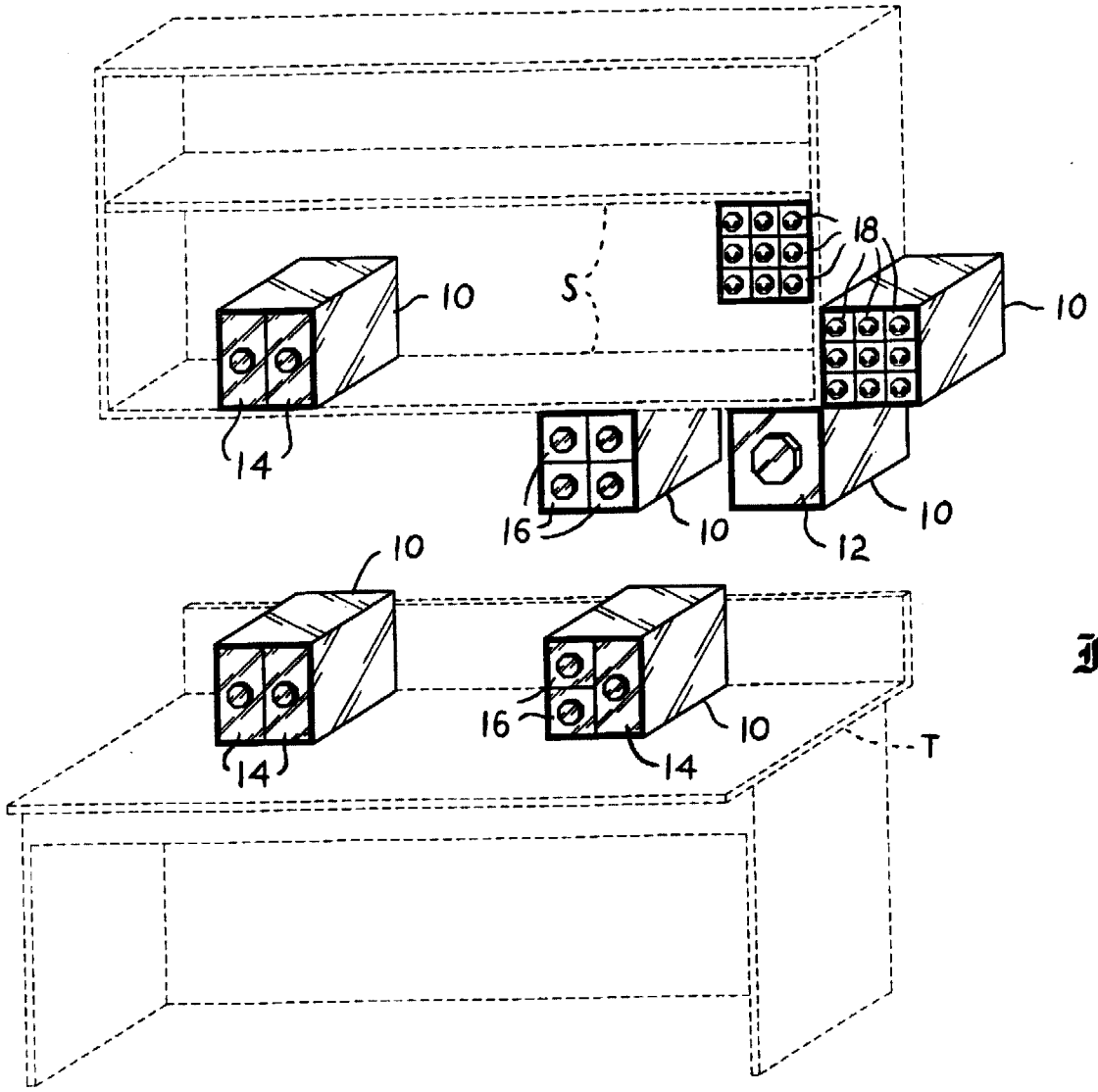
FIG. 1 is a perspective view of a plurality of different sizes of the present storage bins, showing different mounting arrangements of the sleeves or holders for the bins with a household cabinet.
Figure 2:
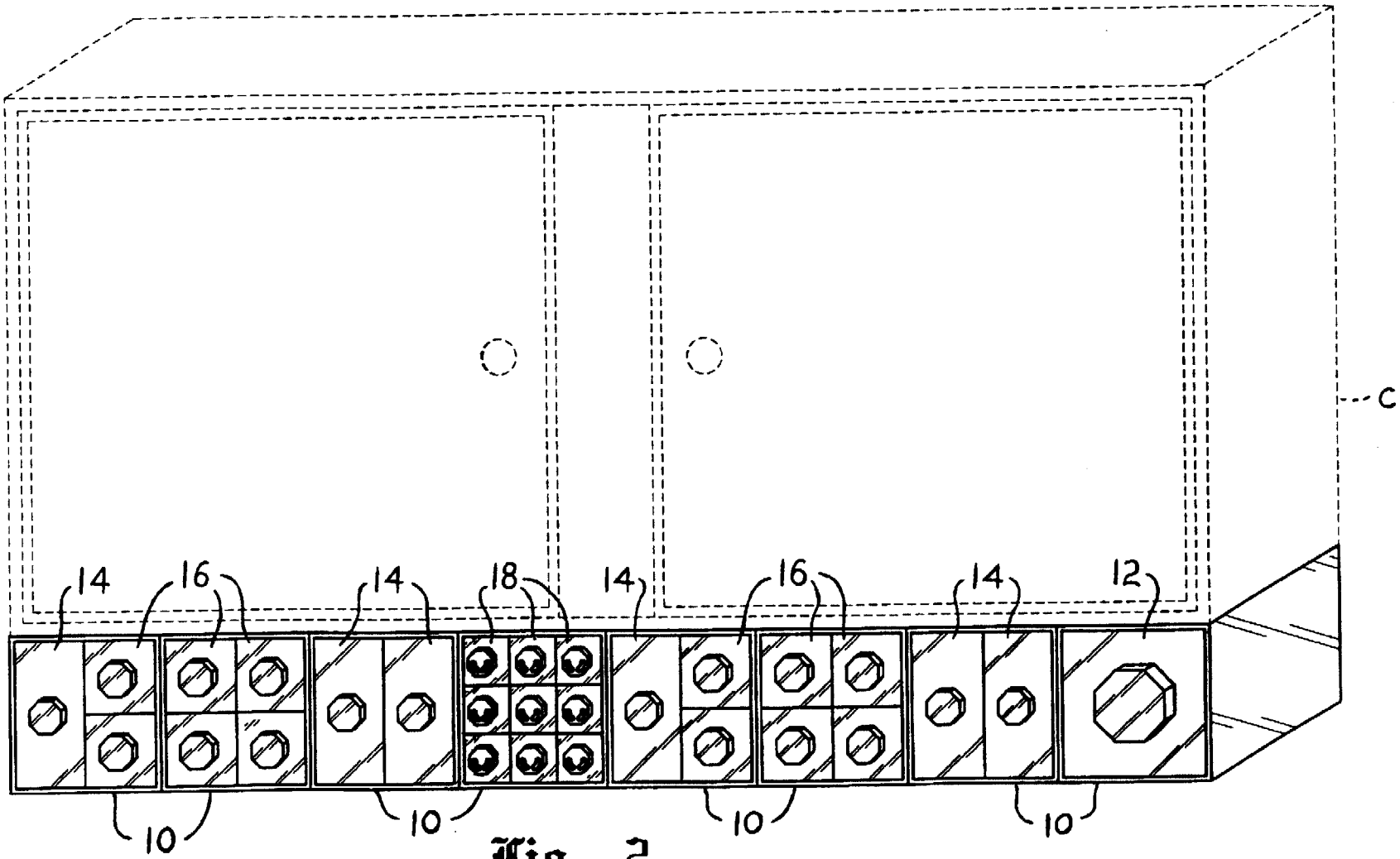
FIG. 2 is a perspective view similar to FIG. 1, showing a plurality of differently sized bins and their sleeves or holders secured to the underside of a cabinet.

Referring now particularly to FIGS. 1 and 2 of the drawings, the present invention will be seen to relate to modular storage bins, with each such bin including a sleeve 10 and a plurality of drawers or bins therein. While all of the sleeves 10 are identical in size and configuration, the bins may be of different sizes, with the larger sizes being integral multiples of the smaller sizes.

Thus, one sleeve 10 may include a single largest bin 12 therein, with such bins 12 adapted to fit closely within the interior of a sleeve 10. Another sleeve 10 may include two half bins 14, each having substantially one half the width of the sleeve 10, but being substantially equal in height to the sleeve interior. Yet another sleeve 10 may include four quarter size bins 16, with such quarter size bins 16 each having substantially one half the height of the interior of a sleeve 10, and being equal in width to that of a half size bin 14, i.e., half the width of a sleeve 10 interior. And still another sleeve 10 may include a total of nine bins 18, each having a width and a height of one third that of the sleeve 10 interior, thereby providing a three by three matrix of nine such one ninth size bins 18 in a single sleeve 10. It will also be seen that another sleeve 10 may be used to contain two vertically stacked quarter size bins 16, with a single half size bin 14 inserted beside the two quarter size bins 16.

While the sleeves 10 may be merely placed atop an underlying surface, such as the countertop T or shelf S of FIG. 1, they may also be secured to the side or underside of a panel, as to the shelves S of FIG. 1. FIG. 2 provides a view of an efficient arrangement of such sleeves 10 and accompanying bins 12 through 18, as they might be installed along the underside of a kitchen or workshop cabinet C or the like. Various sleeve mounting or attachment means may be used, which are described further below. It will be seen that the present invention is not limited to the specific arrangement disclosed in FIGS. 1 and 2 of the drawings, but that the various bins 12 through 18 may be mixed and matched as desired to provide the degree of customizing of storage space and versatility desired by the user.

Figure 3:
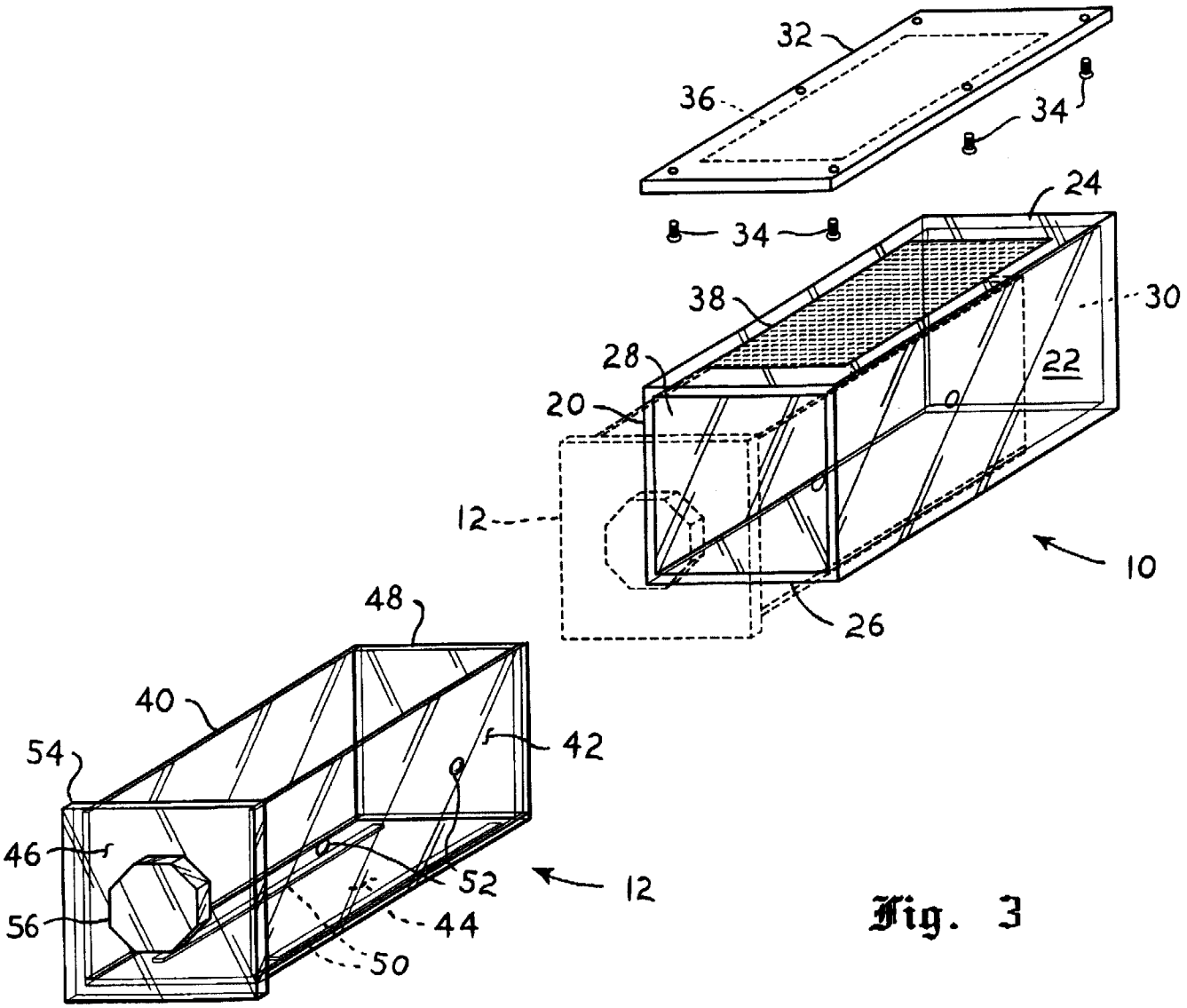
FIG. 3 is a partially broken away perspective view of a bin holder or sleeve of the present invention and mounting plate therefor, showing a larger single bin insertable therein and further details.

FIG. 3 provides a detail view of the specific construction of a sleeve 10 and a full size bin 12, as well as a sleeve mounting means. The sleeve 10 is formed of a first side 20 and an opposite second side 22, and a top panel 24 and opposite bottom panel 26. Each of the sides and panels 20 through 26 has substantially the same width, thereby defining a substantially square cross section for the interior of the sleeve 10. The first and second ends 28 and 30 are open.

FIG. 3 also discloses a mounting means for the sleeve 10, comprising a mounting plate 32 of metal or other suitable material, which may be secured to the side or underside of a panel or surface, such as the side of the shelves S or the underside of the cabinet C respectively of FIGS. 1 and 2. Mounting screws 34 or other means may be used to secure the mounting plate 32 to the desired location. The mounting plate 32 includes a first sheet of hook and loop fastening material 36 thereon, with a mating second sheet of such material 38 being provided on one of the sides or panels 20 through 26 of the sleeve 10 (e.g., on the top panel 24 for an underlying mounting, as shown in FIG. 3). This mounting plate system provides secure mounting for the sleeves 10, and for any bins 12 through 18 which may be inserted therein, particularly on uneven or other surfaces where an adhesive may not work properly. The hook and loop fastening means allows the sleeves 10 to be easily removed for cleaning or other purposes, as desired, yet provides good security for even loaded sleeves and bins secured thereby. It will be seen that other mounting means including mechanically or adhesively securing the sleeve directly to the mounting surface, may be used where suitable and/or desired.

FIG. 3 also provides a view of a full size bin 12. Such bins 12 each comprise a first side 40, an opposite second side 42, a bottom panel 44, and opposite first and second end panels 46 and 48, with the top being open to provide for storage of bulk commodities or other articles therein, as desired. The sides 40 and 42, bottom panel 44, and second end panel 48 are dimensioned so as to fit closely within the interior dimensions of the sleeve 10, but may be slightly smaller than a precise fit in order to allow runners 50, side spacers 52 provided on both sides 40/42, but shown on only one side 42 for clarity in the drawing figure), and/or some other low friction means to be installed thereon to provide for ease of removing and inserting a full bin 12.

While the sides 40/42, bottom panel 44, and end panel 48 are sized to fit within the sleeve 10 interior, it will be seen that the front panel 46 includes a flange 54 extending therefrom, which protrudes beyond the width and height of the full size bin 12 as defined by the sides 40/42 and bottom panel 44. The front panel 46 is dimensioned to match closely the exterior dimensions of the sleeve 10, so as to preclude excessive insertion of the bin 12 into the sleeve 10. Yet, the edge or flange 54 of the front panel 46 does not extend beyond the external dimensions of the sleeve 10, in order to provide a compact installation without the front panel flange 54 catching on a cabinet edge or the like to which the sleeve 10 may be mounted.

To provide for ease of removal of the bin 12 from the sleeve 10, a handle or knob 56 may be provided on the front or first end panel 46 of the full size bin 12. This knob or handle 56 may also cooperate with latching means to positively retain the bin 12 within the sleeve 10, which latching means is discussed further below.

Figure 4:
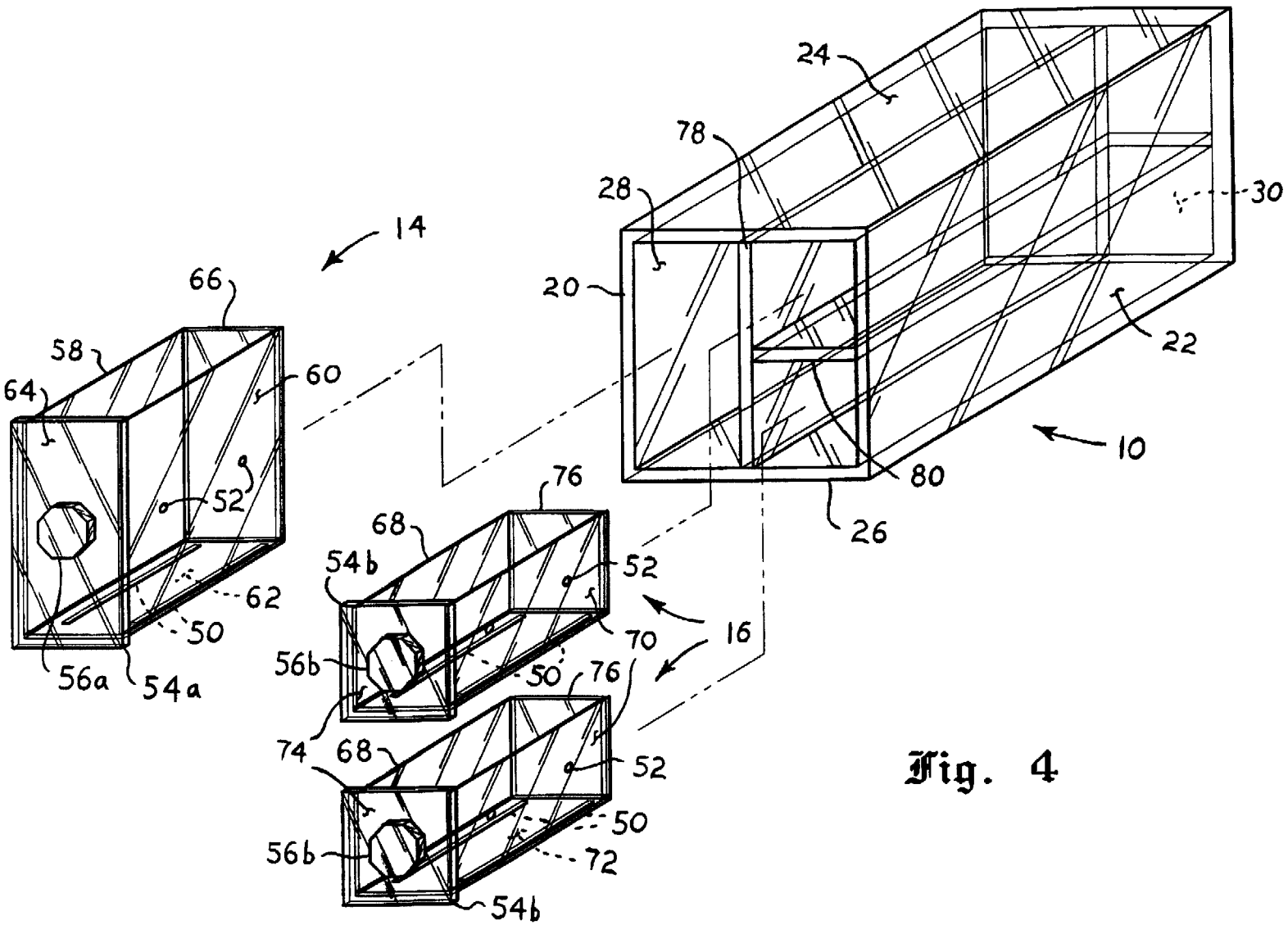
FIG. 4 is an exploded perspective view of a bin holder or sleeve partitioned to hold a half width bin and two quarter size bins, and the associated bins and details.

FIG. 4 provides an exploded perspective view of a sleeve 10 which has been configured to contain a single half size bin 14 and two quarter size bins 16. Each of the bins 14/16 will be seen to be configured similarly to the full size bins discussed above. The half size bin 14 is formed of opposite first and second sides 58 and 60, a bottom panel 62, and opposite first and second end panels 64 and 66, with an open top. Each of the quarter size bins 16 includes opposite first and second sides 68/70, a bottom panel 72, and opposite first and second end panels 74 and 76. Both the half size and quarter size bins 14 and 16 may also include low friction means, such as bottom runners 50 and/or side spacers or buttons.52, in the manner of the full size bins 12, and each of the front panels 64/74 also includes an extended flange, respectively **54*a* and 54*b*, to preclude excessive insertion of the bins 14/16 into the bin sleeve 10**.

Due to the smaller cross sectional size particularly of the quarter size bin 16, the manufacture of such bins having a length equal to that of the full length of the sleeves 10, may result in a somewhat excessive length relative to the width of the bin 16. Accordingly, such quarter size bins 16 (and ninth size bins discussed further below) are preferably manufactured to have a length only half that of the length of the sleeves 10, as shown by their relative lengths in FIG. 4. Larger bins, such as the full size bins 12 and the half size bins 14, are preferably manufactured to have a length substantially the same as that of the bin sleeves 10. (It will be noted that the half size bin 14 of FIG. 4 appears to have a length only half that of the bin sleeve 10 of FIG. 4. Such half size bins 14 may be manufactured to half length, if desired, but may also have a full length if desired.)

Each of the half size and quarter size bins 14/16 includes a handle or knob, respectively **56*a*/56*b*, scaled in proportion to the size of the front panel 64/74 of the respective bins 14/16. Otherwise the knobs 56/56*a*/56*b* of the bins 12/14/16 are similar polygonal shapes (preferably octagonal, although other shapes may be used), to provide uniformity of appearance between each of the different sizes of bins 12/14/16. As in the case of the full size bins 12f the knobs 56*a*/56*b* of the half and quarter size bins 14/16 may include latching means (described further below) providing for positive retention of the bins 14/16 within a sleeve 10**.

As each of the half size and quarter size bins 14/16 have a cross sectional area considerably less than that of a sleeve 10, some means must be provided to preclude unwanted lateral or vertical displacement of a bin 14/16 within a sleeve 10, particularly when only one such smaller bin 14/16 is placed therein. This is accomplished by means of a vertical partition 78, which is inserted within the sleeve 10 and which serves to divide the sleeve 10 interior laterally into two substantially equal portions. Thus, two half size bins 14 may be placed within a sleeve 10 and each may be withdrawn as desired, without the second such bin 14 being displaced to block the reinsertion of the withdrawn bin 14 when it is reinserted into the sleeve 10. A second horizontal partition 80 is provided between the vertical partition 78 and the side wall(s) 22 (and/or 20) of the sleeve 10, to provide vertical separation of two quarter size bins 16, in much the same manner. (It will be seen that the horizontal partition 80 may extend across the full width of the interior of the sleeve 10 and interlock with the vertical partition 78 to provide for four quarter size bins 16, if desired.)

Figure 5:
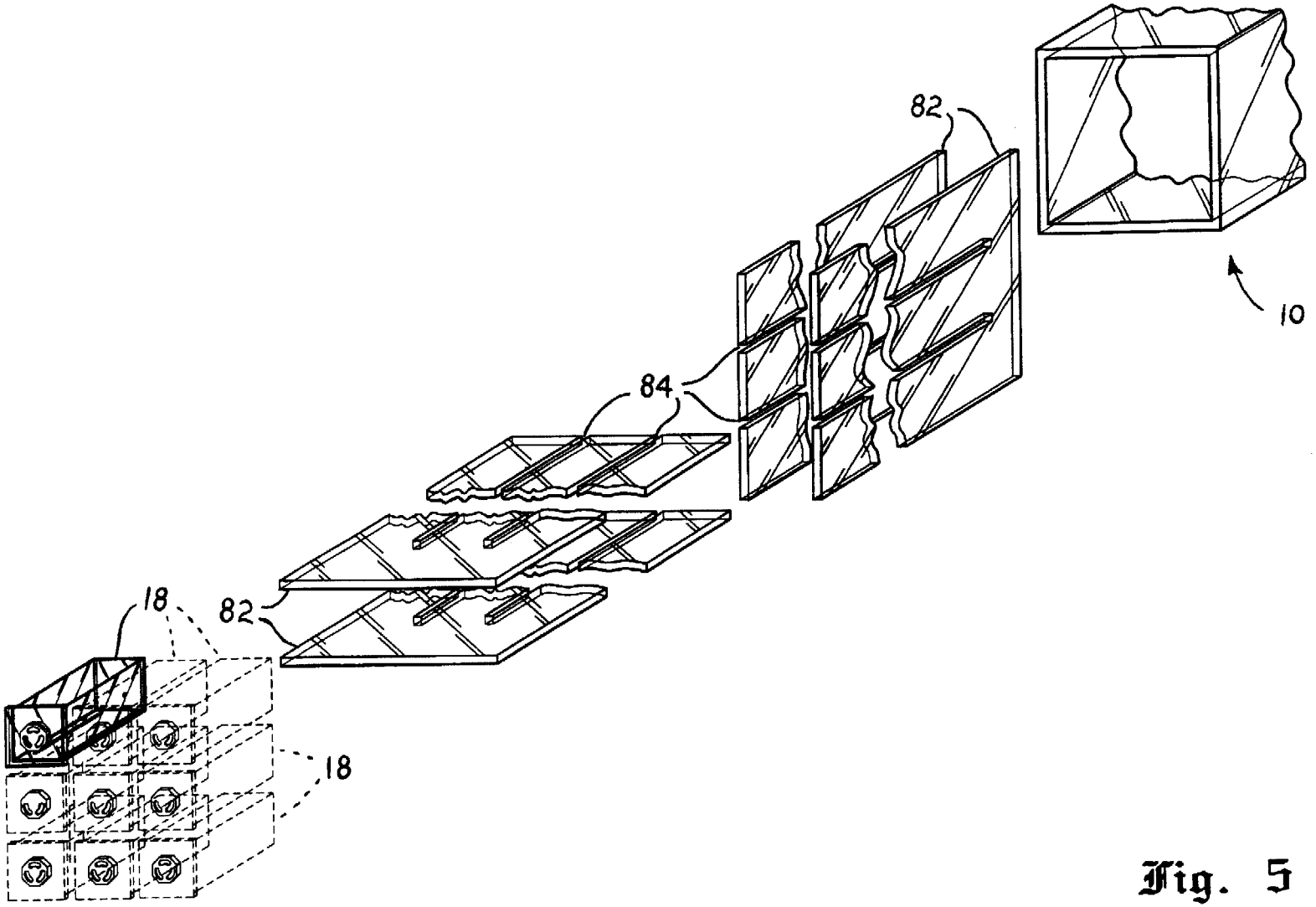
FIG. 5 is an exploded perspective view of the front portion of a bin holder or sleeve and interlocking partitions providing for the placement of nine smaller bins therein, and a smaller closed bin adapted for the bulk storage of a spice or other commodity. therein.

A variation on the above described horizontal and vertical partitions 78 and 80 is shown in FIG. 5, wherein four partitions 82 each having two elongate slots 84 therein, are assembled together in a two by two matrix of two horizontal and two vertical partitions 82. One pair of partitions 82 (e.g., the horizontally disposed pair) are positioned with their slots 84 facing rearwardly, while the other pair (e.g., the vertical pair) are positioned with their slots 84 facing forwardly. Thus, the slots 84 of the pairs of partitions 82 will interlock, to hold the partitions 82 immovably relative to one another. (The partitions 82 need only be half the length of the sleeve 10, as the ninth size bins 18 adapted to fit within the partition 82 spaces are preferably only half the length of the sleeve 10. However, the partitions 82 may be made full length, if desired.)

In turn, the partition 82 assembly is inserted into a sleeve 10, thereby dividing the interior of the sleeve into a three by three matrix of nine separate volumes. The one ninth size bins 18 are adapted to fit closely within each of the nine interior spaces provided by the interlocking partitions 82 within the sleeve 10, with the partitions 82 precluding displacement of remaining bins 18 when one or more such bins 18 are removed from the sleeve 10. As noted above, the vertical and horizontal partitions 78 and 80, used to separate half size and quarter size bins 14 and 16 from one another within a sleeve 10, may also be slotted if appropriate (with the horizontal partition 80 extending the full width of the sleeve 10), to provide four quadrants for the insertion of four of the quarter size bins 16 therein.

Figure 6:
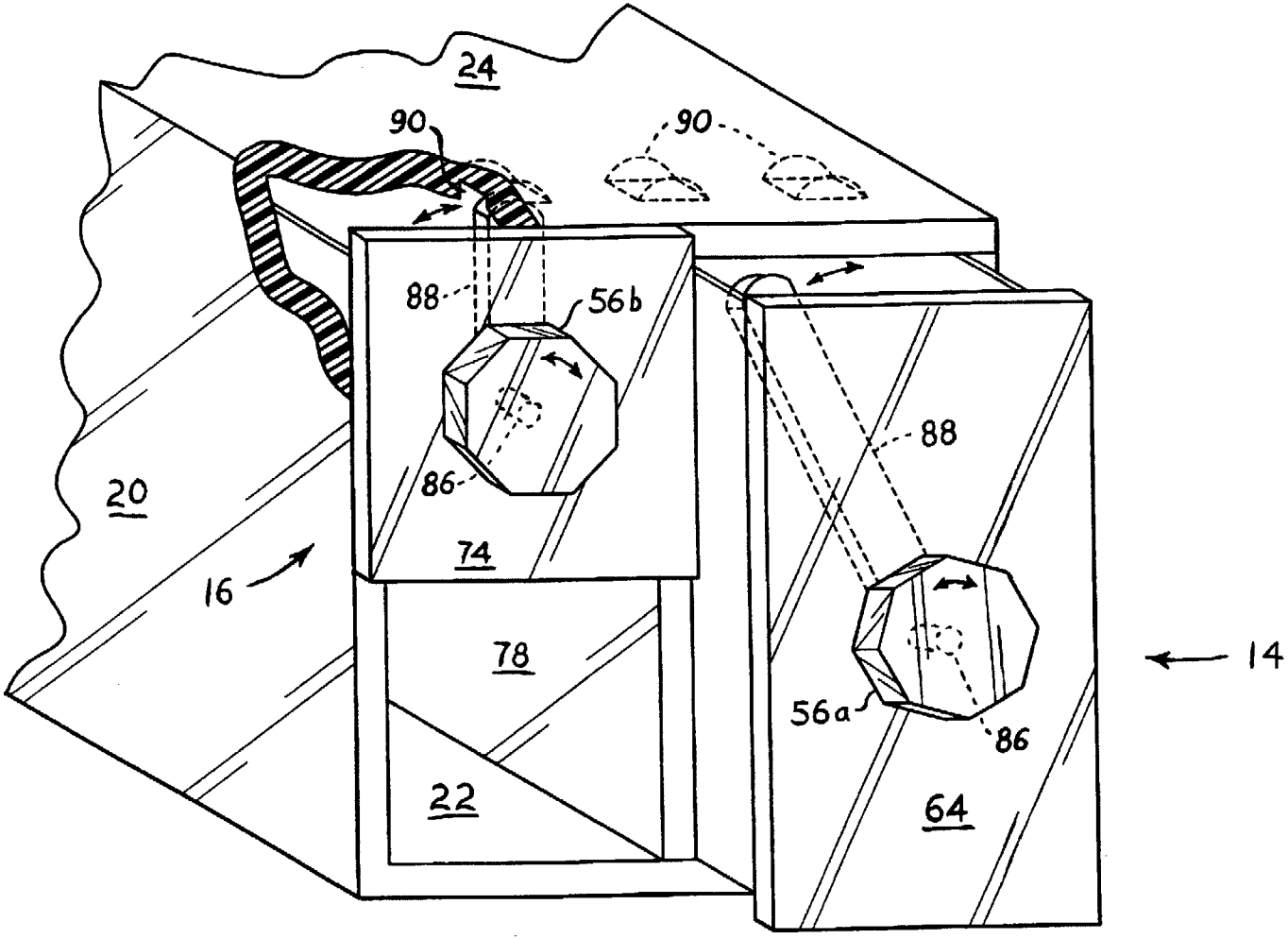
FIG. 6 is a broken away perspective view of a bin holder or sleeve with a half size and quarter size bin therein, showing details of the latching means for such bins.

FIG. 6 provides a detailed view of the latching means provided for the full size, half size, and quarter size bins 12/14/16 to secure such bins positively within a sleeve 10. (While only a half size bin 14 and a quarter size bin 16 are shown, it will be understood that the principle of the latching means applies equally well to a full size bin 12.) Each bin 14/16 includes a rotary knob, respectively **56*a*/56*b* thereon, which knobs also serve as handles to facilitate the withdrawal of the bins 14/16 from a sleeve 10. Each of the knobs 56*a*/56*b* is mounted to a pin or shaft 86 which extends through the respective front panel 64/74 of each bin 14/16. This pin or shaft 86 is in turn secured to a latch lever 88 on the opposite or inner side of the front panel 64/74, with the knob 56*a*/56*b* being immovably affixed relative to the latch lever 88 by means of the connecting pin or shaft 86**.

The top panel 24 of the sleeve 10 includes a plurality of arcuately formed insets 90 therein, which are positioned and adapted to receive the distal ends of the latch levers 88. Preferably, three such slots or insets 90 are provided, with one centrally positioned between each side panel of the sleeve 10 and the other two positioned medially between the central inset and the respective side panel. Thus, the central inset or slot 90 is properly positioned to accept the latch lever of a single full size bin 12 which may be inserted into the sleeve 10, while the two insets 90 to either side are positioned to accept the latch lever 88 of a half width bin (i.e., a half size or quarter size bin 14/16). While such insets 90 are only shown in the top panel 24 of the sleeve 10, it will be understood that two such insets 90 may be provided in a horizontal sleeve partition 80 to either side of the central vertical partition 78, for securing the lowermost bins 16.

Figure 7:
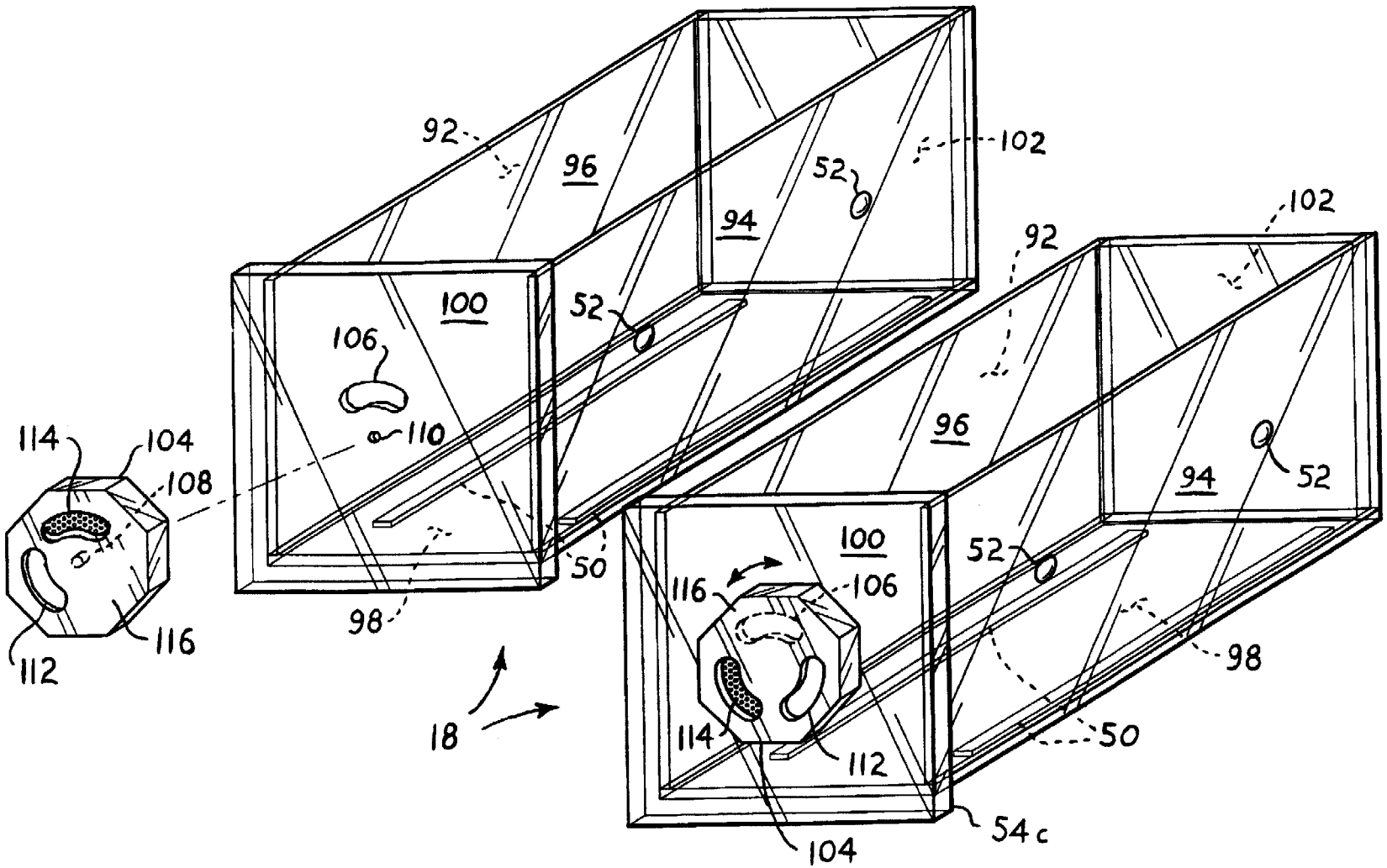
FIG. 7 is a perspective view of a pair of smaller closed bins adapted for bulk storage of spices or other goods, and showing the details of the dispensing means on the front of the bins.

FIG. 7 provides detailed perspective views of a pair of the smallest bins 18 of the present modular storage bins invention. Each of these bins 18 is formed of a first and an opposite second side 92 and 94, a top panel and an opposite bottom panel 96/98, and a first end panel and opposite second end panel 100/102. Thus, each of the one ninth sized bins 18 will be seen to comprise a completely enclosed box, excepting access as described below.

Each of the smaller bins 18 includes a rotary dispensing knob or handle 104 disposed on the front panel 100 thereof. While these knobs 104 have essentially the same shape and rotary operation as the knobs or handles **56/56*a*/56*b* of the bins 12/14/16 discussed above, no latching means is provided with the knobs 104. Instead, a dispensing port 106 is provided through the front panel 100 of each bin 18, and offset from the hole or passage 108 generally centrally located in the front panel 100 for the knob pin 110. The knob 104 in turn includes three approximately equal arcuate areas, with one having a dispensing passage 112 therethrough which is essentially congruent to the dispensing port 106 of the front panel 100, another area having a plurality of smaller holes 114 therethrough, and a third area 116 being completely closed. Thus, a bin 18 may be filled with a bulk commodity (e.g., ground spices or the like) through the dispensing port 106 (or may dispense such commodity from the dispensing port 106), or alternatively may be used to shake such commodity from the small holes 114 in another sector of the knob 104 as desired by rotating the knob 104 to the desired position to locate the passage 112 or the holes 114 over the dispensing port 106. The bin 18 may be sealed by turning the knob 104 to position the closed sector 116 over the dispensing port 106**, as desired.

In summary, the above described modular storage bins and accompanying sleeve(s) will be seen to provide an extremely convenient means of storing and accessing a variety of goods, commodities, and other articles. The bins are extremely useful in the kitchen or pantry for the storage and dispensing of food products, with the open bins 12/14/16 providing easy access for the dispensing of relatively large quantities of goods through the open tops. The smallest bins 18 are particularly adapted for the containment of spices or other finely ground or powdered substances therein, which products may be dispensed in relatively large quantities through an open passage or alternatively shaken from the porous area of the front panel knob.

All of the bins 12/14/16/18 have a unifying theme, in that they are each generally similarly shaped, even though their sizes differ. Each of the knobs **56/56*a*/56*b*, and even the dispensing knob 104, are similarly configured, preferably having an equal number of faces forming an equilateral polygonal shape. Each of the knobs also rotates to provide some function, i.e., the knobs 56/56*a*/56*b* rotate to provide latching or unlatching from their associated sleeve(s), while the knob 104 provides selective dispensing of a product contained within a bin 18**, as described above.

While the present bins 12/14/16/18 and their associated sleeves may be formed of virtually any suitable sheet material, it has been found that clear acrylic plastic provides a very economical, yet durable and easily cleaned material for the bins, which is also quite suitable for use in storing food products. Alternatively, translucent or opaque plastic or other material be used as desired. Such plastic sheet is also easily assembled with appropriate adhesives or solvents.

The present bins and sleeves will also be found to provide an excellent storage system for small parts and components which may be stored in a garage, basement, and/or home workshop. The preferably clear plastic material enables the user to see readily the specific parts or components contained in each bin, at a glance. The specific sizes of the present bins result in practically no wasted space, no matter if a single full size bin 12, two half width bins 14, four quarter size bins 16, or nine of the smallest bins 18 are used, with the appropriate partitions providing the proper spacing between adjacent smaller bins. The partitions may be removed, replaced, or exchanged as desired, allow a bin sleeve 10 to accommodate a variety of differently sized bins as needed. Thus, the present modular storage bin system will be seen to be extremely versatile and valuable for the user thereof.

It is to be understood that the present invention is not limited to the sole embodiment described above, but encompasses any and all embodiments within the scope of the following claims.

I claim:

1. A modular storage bin assembly, including:

at least one sleeve comprising a substantially square cross section and having a first side, an opposite second side, a top panel, a bottom panel, and opposite first and second open ends, with each said side and each said panel defining a sleeve interior;

at least one first bin of full size having at least a first side, an opposite second side, a bottom panel, and opposite first and second end panels, and sized to fit closely within said sleeve;

at least one second bin of half size having at least a first side, an opposite second side, a bottom panel, and opposite first and second end panels, and having a nominal width substantially half that of said sleeve interior;

a plurality of third bins of quarter size each having at least a first side, an opposite second side, a bottom panel, and opposite first and second end panels, and each having a nominal width and a nominal height each substantially half that of said sleeve interior, and;

a plurality of fourth bins of one ninth size each having at least a first side, an opposite second side, a bottom panel, and opposite first and second end panels, and each having a nominal width and a nominal height each substantially one third that of said sleeve interior;

said first, second, and third bins each include handle means on said first end and said fourth bins each include dispensing means on said first end, with said handle means and said dispensing means each comprising similarly configured polygonal rotary knobs, said handle means includes a rotary latch selectively engageable by turning said rotary knob, said dispensing means comprises a rotary dispensing knob providing a single large opening, plural small porous openings adapted for shaking small quantities of goods contained within said fourth bin, and a closure, each selectable by turning said rotary dispensing knob, whereby;

said sleeve provides for the removable insertion therein of a combination of the bins.

2. The modular storage bin assembly of claim 1, wherein:

said first, second, and third bins each have an open top providing access to the interior thereof, and said fourth bins each have a closed top panel.

3. The modular storage bin assembly of claim 1, wherein:

said first and second bins are each substantially equal in length to said sleeve, and said third and fourth bins each have a length substantially half that of said sleeve.

4. The modular storage bin assembly of claim 1, including:

a plurality of partitions installable within said sleeve, said partitions providing for the separation of said second, third, and fourth bins from one another when installed in said sleeve.

5. The modular storage bin assembly of claim 1, including:

low friction means adapted to ease sliding of said bins into and from said sleeve.

6. The modular storage bin assembly of claim 1, wherein:

at least each said side and said top and said bottom panel of said sleeve, and each said side, said bottom panel, and each said end of said bins are formed of transparent plastic sheet material.

7. A modular storage bin assembly, including:

a plurality of equally sized sleeves, each comprising a substantially square cross section and having a first side, an opposite second side, a top panel, a bottom panel, and opposite first and second open ends, with each said side and each said panel defining a sleeve interior for each of said sleeves;

at least one first bin of full size having at least a first side, an opposite second side, a bottom panel, and opposite first and second end panels, and sized to fit closely within one of said sleeves;

at least one second bin of half size having at least a first side, an opposite second side, a bottom panel, and opposite first and second end panels, and having a nominal width substantially half that of said sleeve interior of each of said sleeves;

a plurality of third bins of quarter size each having at least a first side, an opposite second side, a bottom panel, and opposite first and second end panels, and each having a nominal width and a nominal height each substantially half that of said sleeve interior of each of said sleeves, and;

nine fourth bins of one ninth size each having at least a first side, an opposite second side, a bottom panel, and opposite first and second end panels, and each having a nominal width and a nominal height each substantially one third that of said sleeve interior of each of said sleeves;

said first, second, and third bins each include handle means on said first end and said fourth bins each include dispensing means on said first end, with said handle means and said dispensing means each comprising similarly configured polygonal rotary knobs, said handle means includes a rotary latch selectively engageable by turning said rotary knob, said dispensing means comprises a rotary dispensing knob providing a single large opening, plural small porus openings adapted for shaking small quantities of goods contained within said fourth bin, and a closure, each selectable by turning said rotary dispensing knob, whereby;

at least one of said sleeves is adapted for the removable insertion therein of one said first bin, at least one other of said sleeves is adapted for the insertion therein of a first and a second said second bin, at least one other of said sleeves is adapted for the insertion therein of one said second bin and two of said third bins, and at least one other of said sleeves is adapted for the insertion therein of nine of said fourth bins.

8. The modular storage bin assembly of claim 7, wherein:

said first, second, and third bins each have an open top providing access to the interior thereof, and said fourth bins each have a closed top panel.

9. The modular storage bin assembly of claim 7, wherein:

said first and second bins are each substantially equal in length to each of said sleeves, and said third and fourth bins each have a length substantially half that of said sleeves.

10. The modular storage bin assembly of claim 7, including:

a plurality of partitions installable within each of said sleeves, said partitions providing for the separation of said second, third, and fourth bins from one another within one of said sleeves when installed therein.

11. The modular storage bin assembly of claim 7, including:

low friction means adapted to ease sliding of said bins into and from said sleeves.

12. The modular storage bin assembly of claim 7, wherein:

at least each said side and said top and said bottom panel of each of said sleeves, and each said side, said bottom panel, and each said end of said bins are formed of transparent plastic sheet material.

* * * * *